US009409389B1

(12) United States Patent
Donaldson et al.

(10) Patent No.: US 9,409,389 B1
(45) Date of Patent: Aug. 9, 2016

(54) COORDINATION OF PRINTHEAD/SUBSTRATE POSITION WITH TRANSFER OF MARKING MATERIAL

(71) Applicant: Xerox Corporation, Norwalk, CT (US)

(72) Inventors: Patricia J. Donaldson, Pittsford, NY (US); Michael B. Monahan, Webster, NY (US); Joseph L. Filion, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/934,302

(22) Filed: Nov. 6, 2015

(51) Int. Cl.
*B41J 2/045* (2006.01)

(52) U.S. Cl.
CPC ..... *B41J 2/04573* (2013.01); *B41J 2/04586* (2013.01)

(58) Field of Classification Search
CPC ... B41J 2/04573; B41J 2/04586; B41J 29/393
See application file for complete search history.

(56) References Cited

U.S. PATENT DOCUMENTS 5,497,174 A * 3/1996 Stephany ..... B41J 2/04568 347/13
6,325,480 B1 12/2001 Moghadam et al.
6,494,558 B1 12/2002 Doval et al.
6,659,581 B2 12/2003 Schloeman et al.
7,014,378 B2 3/2006 Saito et al.
7,530,657 B2 5/2009 Thiessen et al.
8,179,564 B2 5/2012 Pyne et al.
8,491,081 B2 7/2013 Leighton et al.
2008/0186544 A1 8/2008 Lapstun et al.

* cited by examiner

*Primary Examiner* — Thinh Nguyen
(74) *Attorney, Agent, or Firm* — Gibb & Riley, LLC

(57) ABSTRACT

Devices and methods load a firing distance into a distance counter of a printing device. The firing distance is the distance from the current position of a printhead of the printing device to a marking location on a substrate. These devices and methods count the firing distance in discrete distance increments using the distance counter, based on relative movement of the substrate and printhead. When the distance counter reaches the last discrete distance increment of the firing distance, these devices and methods load the fractional remaining distance of the firing distance into a time counter of the printing device. Then, such devices and methods count the fractional remaining distance in velocity-based distance increments at regular time intervals using the time counter. When the time counter reaches the last velocity-based distance increment of the fractional remaining distance, these devices and methods transfer the marking material from the printhead to the substrate.

20 Claims, 2 Drawing Sheets

COORDINATION OF PRINTHEAD/SUBSTRATE POSITION WITH TRANSFER OF MARKING MATERIAL

BACKGROUND

Systems and methods herein generally relate to printing devices, and more particularly to the coordination of the printhead/substrate position with the transfer of marking material from the printhead to the substrate.

In printing devices, it can be difficult to accurately register drops in the process direction, and ensure that drops from widely separated heads are printed at the required absolute location, especially for 3-dimensional printing. Printheads, such as inkjet printheads, fire when they receive a signal, such as a dot clock signal to cause marking material to be applied to a substrate, such as print media, a plate or platform, etc., to produce printed media, form 3-D items, etc.

SUMMARY

Various methods herein load a dot "firing distance" into a distance counter (e.g., primary encoder) of a printing device. The firing distance is the distance from the current position of a printhead to a marking location on a substrate, and can be supplied from a previously determined item (such as a bitmap and/or dot spacing requirement, etc.), or can be calculated in real time.

These methods count the firing distance in discrete distance increments using the distance counter, based on relative movement of the substrate and the printhead (e.g., based on "tics" counted by a physical item rotating or moving within the printing device). When the distance counter reaches the last discrete distance increment of the firing distance, these methods load the fractional remaining distance of the firing distance into a time counter (e.g., secondary encoder) of the printing device. The fractional remaining distance is a distance less than one of the discrete distance increments counted by the distance counter.

Then, such methods count the fractional remaining distance in velocity-based distance increments at regular time intervals using the time counter. The regular time intervals corresponding to time signals received from a time clock of the printing device. The methods can calculate the distance value of each velocity-based distance increment, based on the current relative velocity between the printhead and the substrate (and the time signal rate output by the time clock); or a nominal (previously calculated) velocity-based distance increment can be used. When the time counter reaches the last velocity-based distance increment of the fractional remaining distance, these methods transfer the marking material from the printhead to the substrate.

Also, such methods can optionally add the next firing distance of a subsequent marking location to the fractional remaining distance, when the fractional remaining distance is transferred to the time counter, and load the sum to the distance counter before repeating the processes of counting the firing distance, loading the fractional remaining distance, counting the fractional remaining distance, and transferring the marking material for the subsequent marking location.

Printing apparatuses herein include, among other components, any form of printhead, a processor operatively (meaning directly or indirectly) connected to the printhead, a support operatively connected to the processor, etc. The support can comprise rollers, a plate or platform, etc., that supports a substrate adjacent to the printhead. The printhead transfers (e.g., ejects, releases, disperses, forces, directs etc.) material in discrete units (e.g., dots, drops, droplets, pixels, etc.) toward, or on to the substrate.

Further, such printing devices include a primary encoder (e.g., distance counter); a secondary encoder (e.g., a time counter) also operatively connected to the processor; and a time clock operatively connected to the time counter. The primary encoder counts in discrete distance increments as the substrate moves relative to the printhead, and the time counter counts in velocity-based distance increments at regular time intervals. The regular time intervals correspond to time signals received by the time counter from the time clock.

The processor loads a firing distance into the distance counter. The firing distance is the distance from the current position of the printhead to a marking location on the substrate. The distance counter counts the firing distance in the discrete distance increments, based on relative movement of the substrate and the printhead.

The processor loads the fractional remaining distance of the firing distance into the time counter when the distance counter reaches the last discrete distance increment of the firing distance. The fractional remaining distance is less than one of the discrete distance increments. The time counter counts the fractional remaining distance in the velocity-based distance increments at the regular time intervals. The processor can determine the velocity-based distance increments based on the current relative velocity between the printhead and the substrate. Then, the printhead transfers the marking material to the substrate when the time counter reaches the last velocity-based distance increment of the fractional remaining distance.

The processor can optionally, at the time that the fractional distance is transferred to the time counter, add the next firing distance of a subsequent marking location and the fractional remaining distance, and supply the sum to the distance counter, when the printing apparatus repeats the processes of counting the firing distance, loading the fractional remaining distance, counting the fractional remaining distance, and transferring the marking material for the subsequent marking location.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
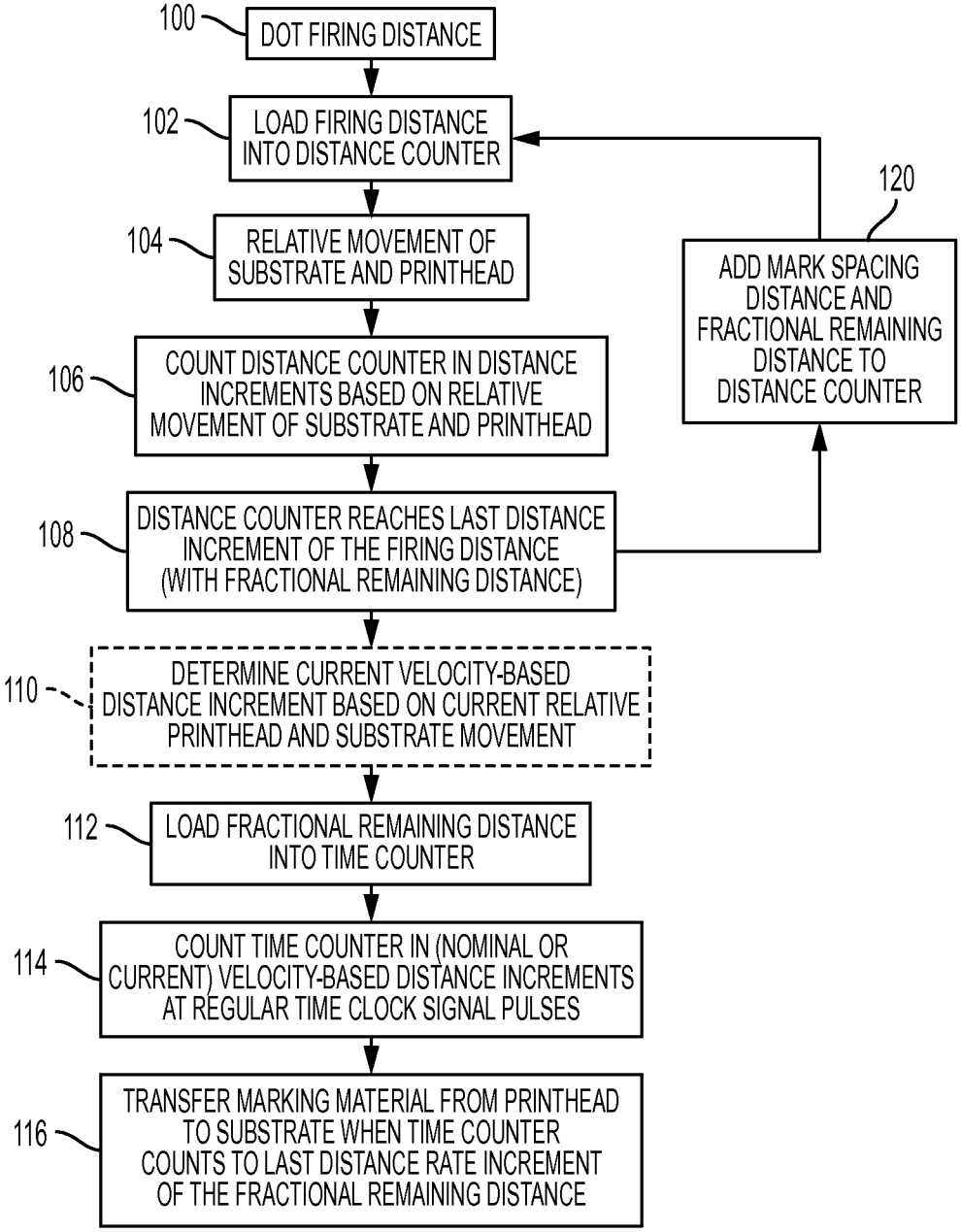
FIG. 1 is a flow diagram of various methods herein.

As mentioned above, printheads (such as inkjet printheads) fire when they receive a signal. There are various techniques for firing dot clocks. Some printers fire directly on an encoder signal. This gives a single firing resolution (dots-per-inch), but ties the firing directly to an absolute location on the encoder, so there is no drift. Other methods calculate the velocity of the substrate at intervals, and then fire dot clocks by integrating the velocity over time.

For example, one system allows a marker to support more than one process resolution, and can also be used to correct for errors in encoder spacing versus substrate location caused by roll-runout and other effects. However, when such systems are effectively doing a piecewise linear fit to the velocity, small errors may creep in, leading to drift in absolute registration over time. Some drift may be acceptable for cut-sheet printing in 2 dimensions, but can cause problems in continuous feed systems or 3-dimensional printing, where drift can cause unacceptable layer-to-layer registration.

The devices and methods herein use a hybrid approach, which retains the advantages of variable dot spacing and run-out correction, while eliminating drift. The devices and methods herein combine a primary distance "clock" that decrements, not on time units, but only when an encoder tic (produced by a physical item moving) is detected, and a secondary time-driven clock, which is started when the primary distance-based clock is within a single encoder tic of the desired dot clock firing position. The secondary time-driven clock decrements in distance units that are based on measured velocity.

In some cases (such as with a drive-roll mounted encoder) the distance the substrate travels between encoder tics may not be the same at all encoder positions. This is particularly true for rotary encoders, where the encoder may not be mounted perfectly centered on a drive roll. In these cases, the distance the substrate moves between encoder tics may depend on the position of the encoder relative to some index location. The encoder will send out an index pulse when the encoder is at one absolute location (for a linear encoder) or angle of rotation (for a rotary encoder). The encoder position can be determined by counting tics past the index.

In order to accommodate this, with devices and methods herein, the distance increment can be a function of the encoder position. For a rotary encoder, a pair of sin and cos functions are used to approximate the distance traveled per tic at different points on the roll. The devices and methods herein apply the correction to the distance increment used by the primary counter. Further, with devices and methods herein, the distance increment can be a function of temperature that compensates for thermal expansion of the drive roll, by making the velocity of the substrate a function of temperature. Thus, these devices and methods compensate for thermal expansion by making the primary clock distance increment a function of the temperature of the substrate and/or compensated for the physical irregularities of any devices by making the primary clock distance increment a function of the encoder position.

This hybrid approach maximizes dot clock spacing accuracy, allows for variable dot spacing, and also ensures accurate location, without drift, over the entire print zone. Therefore, with devices and methods herein, any errors in velocity are only integrated over a single encoder tic interval, which gives absolute position errors that are significantly less than a micron, and which do not accumulate over time.

FIG. 1 is flowchart illustrating exemplary methods herein that perform automated operations that do not require user input. More specifically (as shown in FIG. 1) in item 100, methods herein start with a dot "firing distance" to an initial or the next dot that is to be printed. The firing distance is the distance from the current position of a printhead of the printing device to a marking location on a substrate, and can be supplied from a previously determined item (such as a bitmap and/or dot spacing requirement); or can be calculated in real time. In item 102, these methods load the firing distance into a distance counter (e.g., primary encoder) of a printing device.

The marking location identifies the point at which the printhead transfers (e.g., ejects, releases, disperses, forces, directs, etc.) marking material in discrete units (e.g., dots, drops, droplets, pixels, etc.) toward, or on to the substrate. As would be understood by those ordinarily skilled in the art, a "dot of marking material" can comprise any portion (e.g., droplet, drop, pixel, etc.) of any type of marking material (e.g., liquid ink, solid ink, toner, magnetic ink, etc.); or any other base unit of marking material, whether currently known or developed in the future.

As shown in item 104, the methods herein can cause relative movement between the substrate and printhead by moving either, or both (using actuators, electromagnetic motors, hydraulic devices, pneumatic devices, gears, belts, rollers, etc.). All such physical devices can indicate movement through sensors, by detecting current draw, etc. Therefore, as these physical devices move, they output periodic signals indicating that the substrate and printhead have moved a distance increment relative to one another (measured in any distance units). Further, these devices and methods compensate for thermal expansion by making the distance amount of the distance increment a function of the temperature of the substrate and/or compensated for the physical irregularities of any devices by making the distance amount of the distance increment a function of the encoder position.

In item 106, these methods count the firing distance in discrete distance increments using the distance counter, based on relative movement of the substrate and the printhead in item 104 (e.g., based on "tics" counted by a physical item rotating or moving within the printing device). During the firing distance counting being performed in item 106, the distance counter will reach the last discrete distance increment of the firing distance in item 108. The last discrete distance increment will generally be zero, but could be arbitrarily set at any number or level. Stated more specifically, the last discrete distance increment will be the discrete distance increment that brings the firing distance to zero, or to a positive number that is less than one discrete distance increment.

Unless the firing distance is completely divisible by the discrete distance increment, there will be a fractional remaining distance of the firing distance in the distance counter after the distance counter counts to the last discrete distance increment in item 108. This fractional remaining distance is a distance less than one of the discrete distance increments counted by the distance counter. For example, if the firing distance is 10.25 distance units, and the discrete distance increment is 1 distance unit, the distance counter will count down 10 discrete distance increments, leaving 0.25 distance units as the fractional remaining distance.

In item 110, such methods can optionally (shown using dashed lines) calculate the distance of each velocity-based distance increment, based on the current relative velocity between the printhead and the substrate (and the time signal rate output by the time clock); and this can be performed for each firing distance and each mark that is printed. In other words, the count within the primary encoder will occur at a rate over time based upon how fast the printhead and substrate are moving relative to one another, and item 110 determines the relative velocity based upon that rate.

Item 110, these methods divide the velocity of the printhead/substrate by the rate of time signals produced by the time clock to arrive at the velocity-based distance increment at which a time counter (e.g., secondary encoder) of the printing device will increment. Alternatively, item 110 can be skipped, and a nominal (previously calculated) velocity-based distance increment can be used. In either case, so long as the velocity of the printhead/substrate remains somewhat constant, during each clock pulse from the time clock used by the time counter, the distance between the printhead and the marking location will change by the same distance (e.g., the velocity-based distance) and each increment by the time counter represents this distance.

In item 112, these methods load the fractional remaining distance of the firing distance into the time counter (e.g., secondary encoder) of the printing device. Then, in item 114, such methods count the fractional remaining distance in the velocity-based distance increments, at regular time intervals, using the time counter. Again, the regular time intervals correspond to periodic, regular time signals received from a time clock of the printing device. As shown in item 116, when the time counter reaches the last velocity-based distance increment of the fractional remaining distance (e.g., zero or the last positive number that is smaller than one velocity-based distance increment), these methods transfer the marking material from the printhead to the substrate to print a dot or mark on the substrate.

In item 120, such methods add the next firing distance of a subsequent marking location to the fractional remaining distance from item 108, and load the sum of these distances to the distance counter (item 102) before repeating the processes of counting the firing distance, loading the fractional remaining distance, counting the fractional remaining distance, and transferring the marking material for the subsequent marking location. This step is done at the time that the fractional distance is transferred to the secondary distance counter. Thus, if an additional drop is fired, the dot spacing is added to the fractional remaining distance in the distance counter at the same time (or potentially immediately after) the fractional remaining distance is transferred to the time counter.

For example, the firing distance in item 100 can be, in this example, 10.25 distance units of any distance measurement (dots per inch (DPI), tics, inches, millimeters, microns, etc.); and this may be limited by the resolution of the printing device, the desired dot spacing, etc. The distance counter counts in "discrete" (meaning whole number) distance increments, and not fractions or portions of distance increments in item 106, and in this example decrements in increments of 1 distance unit. Therefore, the fractional remaining distance (item 108) of 0.25 distance units.

In other words, the printhead should disburse the drop of marking material 25/100 of the way into the $10^{th}$ distance increment, to properly meet a requirement of counting to 10.25 distance increments of the primary encoder. Continuing with the same example, if the time counter begins counting down at a velocity-based distance increment of 0.01 distance units from a starting count of 0.25 velocity-based distance increment to zero in item 114, after 25 velocity-based distance increments, the time counter reaches the firing time increment, at which point item 116 disburses the dot of material from the printer to the substrate.

While the foregoing examples discuss that the distance counter and time counter can decrement from a higher value to a zero value, such examples are only used for convenience of illustration, and those ordinarily skilled in the art what understand that the distance counter and time counter could decrement to a non-zero value, or could increment from a lower value (such as zero) to a higher value; or could decrement or increment from any value to a different value. For example, the distant counter and time counter could decrement from a value of 50 and stop at a value of 20, and similarly, the distance counter and time counter could increment from a value of 10 to a value of 20. Regardless of the type of counting performed by the distance counter and the time counter (up or down), when these counters reach a preset value (which could be zero, or a different number) they perform the action described in the flowchart shown in FIG. 1 by causing a remainder value (which could be relative to a non-zero number where counting stops) to be loaded into a different counter, or causing a printhead to transfer marking material, etc.

Figure 2:
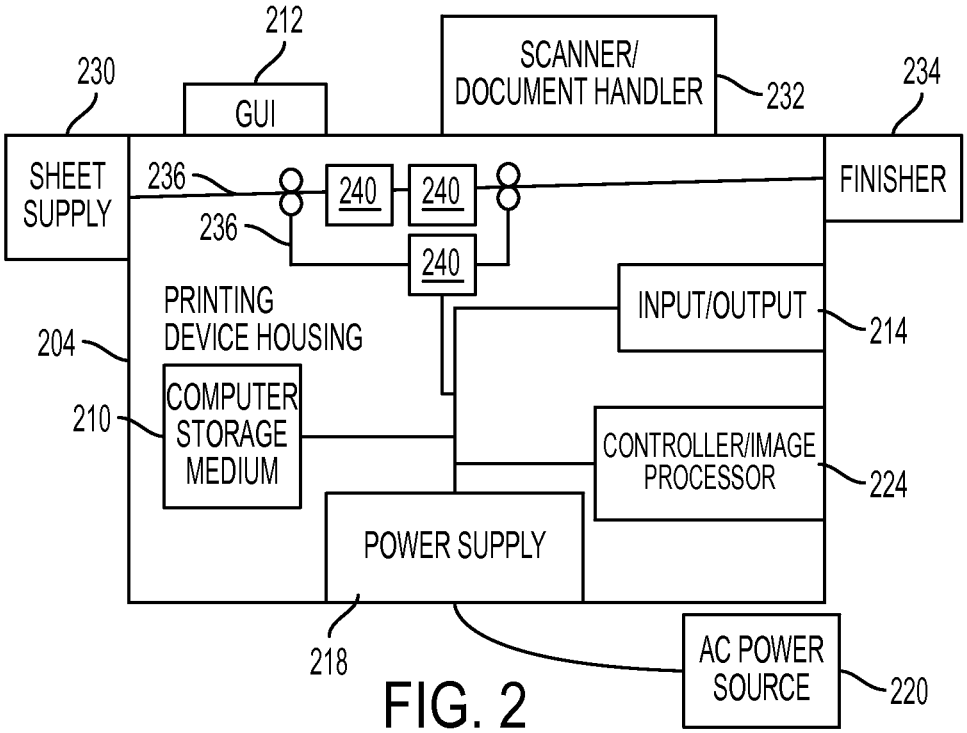
FIG. 2 is a schematic diagram illustrating devices herein.

FIG. 2 illustrates printing device 204, which can be used with systems and methods herein and can comprise, for example, a printer, copier, multi-function machine, multi-function device (MFD), etc. The printing device 204 includes a controller/tangible processor 224 and a communications port (input/output) 214 operatively connected to the tangible processor 224 and to the computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 2, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes many of the components mentioned above and at least one marking device (printing engine(s)) 240 operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a marking material (toner, inks, plastics, organic material, etc.) to continuous media or sheets of media, whether currently known or developed in the future and can include, for example, devices that use a photoreceptor belt or an intermediate transfer belt, devices that print directly to print media (e.g., inkjet printers, ribbon-based contact printers, etc.), 3D printers, etc.

Figure 3:
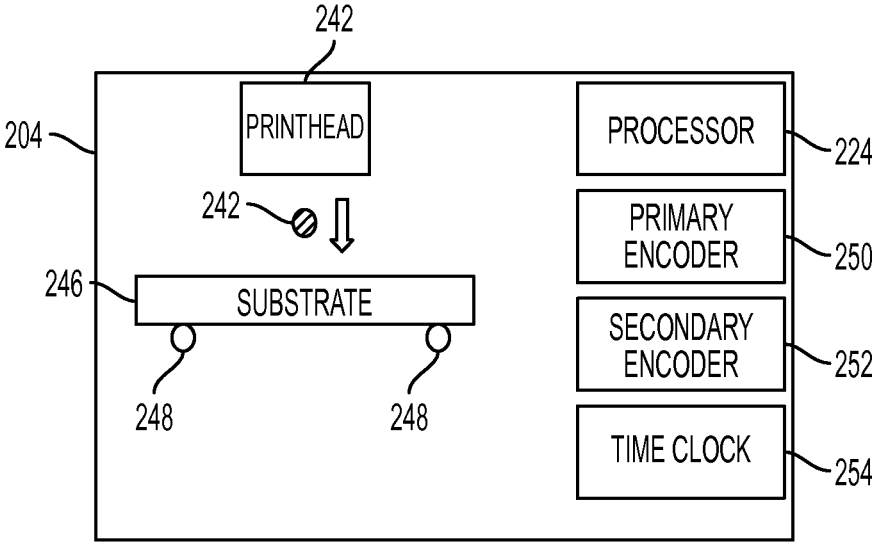
FIG. 3 is a schematic diagram illustrating devices herein.

As additionally shown in FIG. 3, the printing apparatuses 204 herein can include, among other components, any form of printhead 242, a processor 224 operatively connected to the printhead 242, a support 248 operatively connected to the processor 224, etc. The support 248 can comprise rollers, a plate or platform, etc., that supports a substrate 246 adjacent to the printhead 242. The printhead 242 transfers material in discrete units toward, or on to, the substrate 246. Further, such printing devices include a primary encoder 250 (e.g., distance counter) and a secondary encoder 252 (e.g., a time counter) also operatively connected to the processor 224. The primary encoder 250 counts in discrete distance increments as the substrate 246 moves relative to the printhead 242. The time counter 252 counts at regular time intervals correspond to time signals received by the time counter 252 from the time clock 254.

The processor 224 loads a firing distance into the distance counter 250. The firing distance is the distance from the current position of the printhead 242 to a marking location on the substrate 246. The distance counter 250 counts the firing distance in the discrete distance increments, based on relative movement of the substrate 246 and the printhead 242.

The processor 224 loads the fractional remaining distance of the firing distance into the time counter 252 when the distance counter 250 reaches the last discrete distance increment of the firing distance. The fractional remaining distance is a distance less than one of the discrete distance increments. The time counter 252 counts the fractional remaining distance in the velocity-based distance increments at the regular time intervals. The processor 224 can determine the velocity-based distance increments based on the current relative velocity between the printhead 242 and the substrate 246. The printhead 242 transfers the marking material to the substrate 246 when the time counter 252 reaches the last velocity-based distance increment of the fractional remaining distance.

At the time that the fractional remaining distance is transferred to the time counter, the processor 224 can optionally add the next firing distance of a subsequent marking location and the fractional remaining distance, and supply the sum to the distance counter 250, when the printing apparatus repeats the processes of counting the firing distance, loading the fractional remaining distance, counting the fractional remaining distance, and transferring the marking material for the subsequent marking location.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

a printhead;

a processor operatively connected to said printhead;

a support operatively connected to said processor, said support supporting a substrate adjacent to said printhead, said printhead transferring material toward said substrate;

a distance counter operatively connected to said processor, said distance counter counting in discrete distance increments as said substrate moves relative to said printhead; and a time counter operatively connected to said processor, said time counter counting in velocity-based distance increments at regular time intervals, said processor loading a firing distance into said distance counter, said firing distance being a distance from a current position of said printhead to a marking location on a substrate, said distance counter counting said firing distance in said discrete distance increments, based on relative movement of said substrate and said printhead, said processor loading a fractional remaining distance of said firing distance into said time counter when said distance counter reaches a last discrete distance increment of said firing distance, said time counter counting said fractional remaining distance in said velocity-based distance increments at said regular time intervals, and said printhead transferring material to said substrate when said time counter reaches a last velocity-based distance increment of said fractional remaining distance.

2. The printing apparatus according to claim 1, said processor determining said velocity-based distance increments based on a current relative velocity between said printhead and said substrate.

3. The printing apparatus according to claim 1, said fractional remaining distance comprising a distance less than one of said discrete distance increments.

4. The printing apparatus according to claim 1, further comprising a time clock operatively connected to said time counter, said regular time intervals corresponding to time signals received by said time counter from said time clock.

5. The printing apparatus according to claim 1, said processor at least one of:

compensating for thermal expansion by making a distance amount of said discrete distance increments a function of temperature of said substrate; and compensating for physical irregularities of any devices by making said distance amount of said discrete distance increments a function of encoder position.

6. A printing apparatus comprising:

a printhead;

a processor operatively connected to said printhead;

a support operatively connected to said processor, said support supporting a substrate adjacent to said printhead, said printhead transferring material toward said substrate;

a distance counter operatively connected to said processor, said distance counter counting in discrete distance increments as said substrate moves relative to said printhead; and a time counter operatively connected to said processor, said time counter counting in velocity-based distance increments at regular time intervals, said processor loading a firing distance into said distance counter, said firing distance being a distance from a current position of said printhead to a marking location on a substrate, said distance counter counting said firing distance in said discrete distance increments, based on relative movement of said substrate and said printhead, said processor loading a fractional remaining distance of said firing distance into said time counter when said distance counter reaches a last discrete distance increment of said firing distance, said time counter counting said fractional remaining distance in said velocity-based distance increments at said regular time intervals, said printhead transferring material to said substrate when said time counter reaches a last velocity-based distance increment of said fractional remaining distance, said processor adding a next firing distance of a subsequent marking location and said fractional remaining distance to said distance counter, and said printing apparatus repeating said counting said firing distance, said loading said fractional remaining distance, said counting said fractional remaining distance, and said transferring said material for said subsequent marking location.

7. The printing apparatus according to claim 6, said processor determining said velocity-based distance increments based on a current relative velocity between said printhead and said substrate.

8. The printing apparatus according to claim 6, said fractional remaining distance comprising a distance less than one of said discrete distance increments.

9. The printing apparatus according to claim 6, further comprising a time clock operatively connected to said time counter, said regular time intervals corresponding to time signals received by said time counter from said time clock.

10. The printing apparatus according to claim 6, said processor at least one of:

compensating for thermal expansion by making a distance amount of said discrete distance increments a function of temperature of said substrate; and compensating for physical irregularities of any devices by making said distance amount of said discrete distance increments a function of encoder position.

11. A method comprising:

loading a firing distance into a distance counter of a printing device, said firing distance being a distance from a current position of a printhead of said printing device to a marking location on a substrate;

counting said firing distance in discrete distance increments using said distance counter, based on relative movement of said substrate and said printhead;

loading a fractional remaining distance of said firing distance into a time counter of said printing device when said distance counter reaches a last discrete distance increment of said firing distance;

counting said fractional remaining distance in velocity-based distance increments at regular time intervals using said time counter; and transferring material from said printhead to said substrate when said time counter reaches a last velocity-based distance increment of said fractional remaining distance.

12. The method according to claim 11, further comprising determining said velocity-based distance increments based on a current relative velocity between said printhead and said substrate.

13. The method according to claim 11, said fractional remaining distance comprising a distance less than one of said discrete distance increments.

14. The method according to claim 11, said regular time intervals corresponding to time signals received from a time clock of said printing device.

15. The method according to claim 11, further comprising at least one of:

compensating for thermal expansion by making a distance amount of said discrete distance increments a function of temperature of said substrate; and compensating for physical irregularities of any devices by making said distance amount of said discrete distance increments a function of encoder position.

16. A method comprising:

loading a firing distance into a distance counter of a printing device, said firing distance being a distance from a current position of a printhead of said printing device to a marking location on a substrate;

counting said firing distance in discrete distance increments using said distance counter, based on relative movement of said substrate and said printhead;

loading a fractional remaining distance of said firing distance into a time counter of said printing device when said distance counter reaches a last discrete distance increment of said firing distance;

counting said fractional remaining distance in velocity-based distance increments at regular time intervals using said time counter;

transferring material from said printhead to said substrate when said time counter reaches a last velocity-based distance increment of said fractional remaining distance;

adding a next firing distance of a subsequent marking location and said fractional remaining distance to said distance counter; and repeating said counting said firing distance, said loading said fractional remaining distance, said counting said fractional remaining distance, and said transferring said material for said subsequent marking location.

17. The method according to claim 16, further comprising determining said velocity-based distance increments based on a current relative velocity between said printhead and said substrate.

18. The method according to claim 16, said fractional remaining distance comprising a distance less than one of said discrete distance increments.

19. The method according to claim 16, said regular time intervals corresponding to time signals received from a time clock of said printing device.

20. The method according to claim 16, further comprising at least one of:

compensating for thermal expansion by making a distance amount of said discrete distance increments a function of temperature of said substrate; and compensating for physical irregularities of any devices by making said distance amount of said discrete distance increments a function of encoder position.

* * * * *